US006009178A

United States Patent [19]

Abel et al.

[11] Patent Number: 6,009,178

[45] Date of Patent: Dec. 28, 1999

[54] METHOD AND APPARATUS FOR CROSSTALK CANCELLATION

[75] Inventors: Jonathan S. Abel, Palo Alto; Stacy Lynn Welsh, Menlo Park, both of Calif.

[73] Assignee: Aureal Semiconductor, Inc., Fremont, Calif.

[21] Appl. No.: 08/710,334

[22] Filed: Sep. 16, 1996

[51] Int. Cl.[6] ..... H04R 5/00

[52] U.S. Cl. ..... 381/1

[58] Field of Search ..... 381/25, 17, 1, 381/300, 309, 26

[56] References Cited

U.S. PATENT DOCUMENTS

| | | | |
|---|---|---|---|
| 3,236,949 | 2/1966 | Atal et al. | 179/1 |
| 4,893,342 | 1/1990 | Cooper et al. | 381/26 |
| 4,910,779 | 3/1990 | Cooper et al. | 318/26 |
| 4,975,954 | 12/1990 | Cooper et al. | 381/26 |
| 5,034,983 | 7/1991 | Cooper et al. | 381/25 |
| 5,131,651 | 7/1992 | You . | |
| 5,136,651 | 8/1992 | Cooper et al. | 381/25 |
| 5,404,406 | 4/1995 | Fuchigami et al. | 381/17 |

OTHER PUBLICATIONS

Manfred R. Schroeder, "Models of Hearing" IEEE Proceedings vol. 63, pp. 1332–1350 (Sep. 1975).

Manfred R. Schroeder, "Computer Models for Concert Hall Acoustics", The American Journal of Physics, vol. 41, pp. 461–471 (Apr. 1973).

*Primary Examiner*—Vivian Chang

[57] ABSTRACT

A system and method are disclosed for providing a two channel signal to the ears of a listener through an audio system. The audio system includes a plurality of audio signals which are played through a plurality of loudspeakers. A plurality of propagation paths exist from the loudspeakers to the ears of the listener. Crosstalk is canceled in the audio system by providing the two channel signal which is to be received at the ears of the listener as an input to a crosstalk compensating network. The crosstalk compensating network is operative to provide an inverse crosstalk signal which cancels the crosstalk caused by the propagation of the audio signals from the plurality of loudspeakers along the plurality of propagation paths to the ears of the listener. The two channel signal is equalized via an equalization transfer function whose magnitude is substantially proportional to a first function applied to the frequency crossfade between a second function of a monophonic compatible equalization transfer function and the second function of a binaurally transparent equalization function. A plurality of audio signals are generated which are suitable for playback through the plurality of audio speakers and propagation to the ears of the listener.

30 Claims, 9 Drawing Sheets

METHOD AND APPARATUS FOR CROSSTALK CANCELLATION

BACKGROUND OF THE INVENTION

The present invention relates generally to the field of audio signal processing, and more particularly to a method and apparatus for crosstalk cancellation in an audio system.

There are a number of applications in which the left and right channels of a stereo audio signal are developed independently for the left ear and the right ear of a listener. For example, systems have been developed to simulate a virtual sound source in an arbitrary perceptual location relative to a listener. These so-called virtual acoustic displays apply separate left-ear and right-ear filters to a source signal in order to mimic the acoustic effects of the human head, torso, and pinnae on source signals arriving from a particular point in space. These filters are referred to as head related transfer functions (HRTF's). HRTF's are functions of position and frequency which are different for different individuals. When a sound signal which is passed through a filter that implements the HRTF for a given position, the sound appears to the listener to have originated from that position.

HRTF's used in virtual audio displays are often tabulated based on measurements made by recording the response at a listener's ears to test signals generated by speakers placed at various locations around the listener. In systems where the measurement of each individual user is impractical, a generic HRTF known to work well for a wide population of listeners is used. Methods have been developed to efficiently implement virtual audio displays using HRTF's. U.S. Pat. No. 5,404,406 issued to Fuchigami et. al. which is herein incorporated by reference describes one implementation of a virtual audio display using HRTF's. U.S. patent application Ser. Nos. 08/303,705 and 08/241,867 of Abel, which are each herein incorporated by reference, also teach efficient implementations of virtual audio displays.

Since sound signals can be created which appear to emanate from arbitrarily positioned virtual sound sources, it is possible to create left and right ear signals which appear to a listener to have originated from a set of virtual speakers. FIG. 1 illustrates a system which creates five virtual speakers for a listener 101 which include a left virtual speaker 110, a right virtual speaker 112, a center virtual speaker 114, a right rear virtual speaker 116, and a left rear virtual speaker 118 when listener 101 is wearing headphones which include right speaker 120 and left speaker 122. Such a system is useful, for example, for listening to Dolby ProLogic encoded source material over headphones. Once the HRTF is determined from each of the five speakers to each of the listener's ears, a sound signal from each of the virtual speaker is generated for the listener's left and right ears by passing the signal associated with each virtual speaker through a filter which implements the HRTF corresponding to that speaker's position with respect to the left or right ear of listener 101. The resulting signal is then played through headphone speaker 120 and headphone speaker 122 at the listener's right and left ears, respectively.

Stereo audio streams in which the left and right channels are developed independently for the left and right ears of a listener are referred to as binaural signals. Headphones are typically used to send binaural signals directly to a listener's left and right ears. The main reason for using headphones is that the sound signal from the speaker on one side of the listener's head generally does not travel around the listener's head to reach the ear on the opposite side. Therefore, the application of the signal by one headphone speaker to one of the listener's ears does not interfere with the signal being applied to the listener's other ear by the other headphone speaker through an external path. Headphones are thus an effective way of transmitting a binaural signal to a listener, however, it is not always convenient to wear headphones or earphones (for example, in the case of an arcade game where maintenance and hygiene concerns arise), and a solution using a pair of speakers which are not worn as headphones is desired.

Complications arise in systems which do not deliver the audio signal directly to the listener's ear. If a binaural signal is used to drive free standing speakers directly, then the listener will hear contributions from each speaker at each ear. The receipt of the signal intended for the right ear at the left ear and vice versa is referred to as "crosstalk." It is necessary in such systems to compensate for or to cancel somehow the crosstalk so that the desired binaural signal is effectively applied to each of the listener's ears.

Various systems for canceling crosstalk have been developed. B. S Atal and M. R. Schroeder developed a system which implements crosstalk cancellation over the entire audio spectrum (i.e., 20 Hz to 20 Khz). The system is described in "Computer Models for Concert Hall Acoustics" The American Journal of Physics, vol. 41, pp. 461–471 (April 1973) which is herein incorporated by reference; "Models of Hearing" IEEE Proceedings vol. 63, p. 1332–1350 (Sept. 1975) which is herein incorporated by reference; and U.S. Pat. No. 3,236,949 issued to Atal et. al which is herein incorporated by reference. The Atal and Schroeder system reproduces arbitrarily located sound images with two loudspeakers using a crosstalk cancellation system which includes an equalization filter. When using the Atal Schroeder crosstalk canceler and equalization filter, the crosstalk signals are exactly canceled and the input binaural signal appears intact at the listener's ears if the system is designed using the listener's HRTF and the listener is in the exact designed position relative to the speakers. The Atal and Schroeder system works reasonably well for a listener whose HRTF reasonably approximates the HRTF for which the system is designed, and whose head is positioned and oriented correctly in a so-called "sweet spot." However, if the listener's head is turned or positioned away from the sweet spot, or if the listener's HRTF is not a close approximation of the HRTF for which the system is designed, then the crosstalk cancellation is not effective and accurate localization of sounds by the listener is no longer realized.

U.S. Pat. Nos. 4,910,779, 4,975,954, 4,893,342, 5,034,983, and U.S. Pat. No. 5,136,651 issued to Cooper et. al, each of which are herein incorporated by reference, describe a system which limits the response of the crosstalk canceling filter used to a frequency substantially below 10 Khz and also implements a different equalization filter than the equalization filter which is described by Atal and Schroeder.

What is needed is an apparatus and method for canceling the crosstalk between signals from speakers which effectively cancels the crosstalk when the HRTF of the listener is close to a standard HRTF and the listener's head is in a standard location, and which is also robust so that the system performs reasonably well and undesirable sound effects are not heard by a listener whose HRTF varies from the designed for HRTF or whose head is not positioned and oriented correctly in the standard location. Such a system could be used to effectively simulate an array of five virtual speakers using only two loudspeakers or to present sounds to a listener which appear to come from arbitrarily placed sources.

SUMMARY OF THE INVENTION

Accordingly, the present invention provides a crosstalk cancellation system which includes an equalizer which provides reasonably good sound even when the user is not positioned and oriented correctly in the sweet spot or when the HRTF of the listener does not closely correspond to the HRTF used in designing the system.

In one embodiment, a method for providing a two channel signal to the ears of a listener through an audio system is described. The audio system includes a plurality of audio signals which are played through a plurality of loudspeakers. A plurality of propagation paths exist from the loudspeakers to the ears of the listener. Crosstalk is canceled in the audio system by providing the two channel signal which is to be received at the ears of the listener as an input to a crosstalk compensating network. The crosstalk compensating network is operative to provide an inverse crosstalk signal which cancels the crosstalk caused by the propagation of the audio signals from the plurality of loudspeakers along the plurality of propagation paths to the ears of the listener. The two channel signal is equalized via an equalization transfer function whose magnitude is substantially proportional to a first function applied to the frequency crossfade between a second function of a monophonic compatible equalization transfer function and the second function of a binaurally transparent equalization function. A plurality of audio signals are generated which are suitable for playback through the plurality of audio speakers and propagation to the ears of the listener.

These and other features and advantages of the present invention will be presented in more detail in the following specification of the invention and the figures.

DETAILED DESCRIPTION OF THE INVENTION

Figure 1:
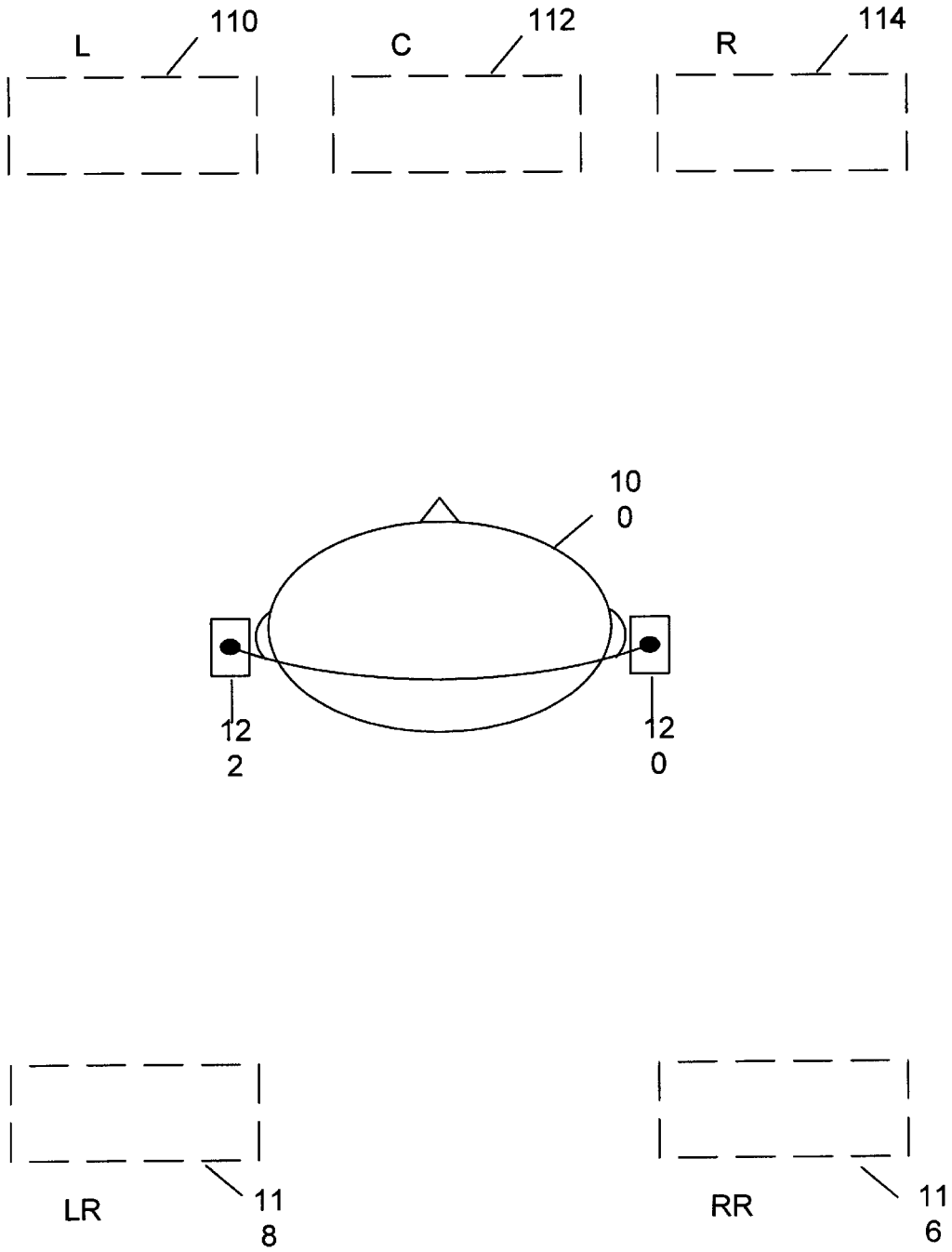
FIG. 1 illustrates a system which creates five virtual speakers for a listener.
Figure 2:
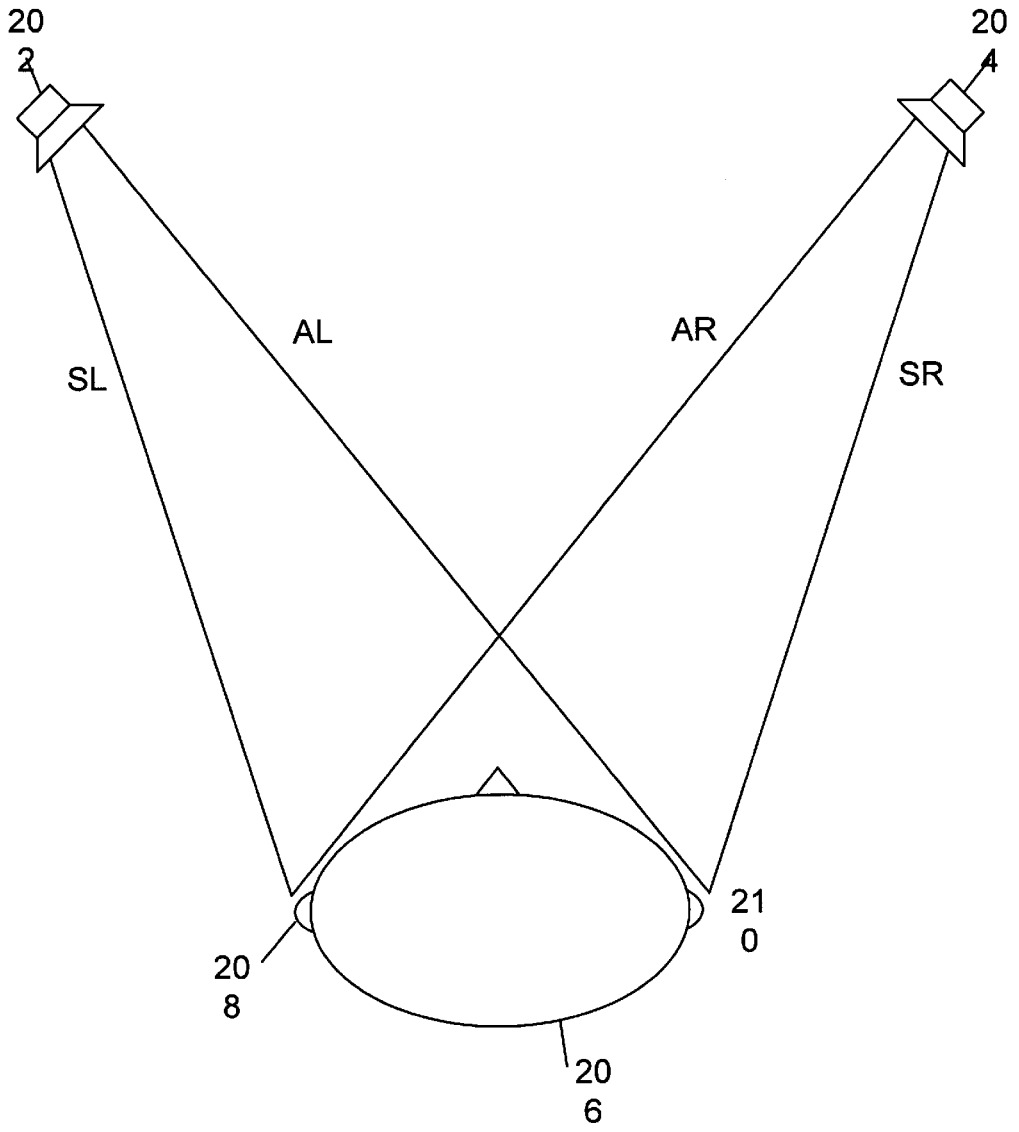
FIGURE 2 PRIOR ART
FIG. 2 illustrates a system where sound signals from a left speaker and a right speaker are both heard by a listener at the listener's left ear and right ear.

FIG. 2 illustrates a system where sound signals from a left speaker 202 and a right speaker 204 are both heard by a listener 206 at the listener's left ear 208 and right ear 210. The transfer function between left speaker 202 and left ear 208 is represented by SL and the transfer function between left speaker 202 and right ear 210 is represented by AL. The transfer function between right speaker 204 and left ear 208 is represented AR and the transfer function between right speaker 202 and right ear 210 is represented by SR. For simplicity, the system shown is symmetrical with respect to listener 206 so that AL=AR and SL=SR. Therefore, A will hereinafter represent both AL and AR and be referred to as the far ear transfer function and S will hereinafter represent both SL and SR and be referred to as the near ear transfer function. Each transfer function includes an amplitude component which may vary as a function of frequency as well as a phase component which also may vary as a function of frequency. It will be apparent to one of ordinary skill in the art that, although a symmetric two speaker system is described, the present invention also includes any arbitrary system of speakers so long as the near ear and far ear transfer functions of each speaker are accounted for according to the system and method described below.

If the right channel of a binaural audio signal is passed through a filter which implements the transfer function 1/S and is played through right speaker 204, then the correct right channel signal will propagate to the right ear since the 1/S transfer function cancels the S transfer function resulting from the propagation of the sound wave through space to the near ear. The 1/S filter is said to "naturalize" the signal. The 1/S filter compensates for the change which the signal undergoes as it propagates through space to the near ear. Similarly, if the left channel of a binaural signal is passed through a filter which implements the transfer function 1/S and is played through left speaker 202, then the correct left channel signal will propagate to the left ear since the 1/S filter transfer function cancels the S transfer function which occurs due to the propagation of the sound wave through space to the near ear. Crosstalk occurs because the sound from the right speaker also propagates to the left ear and is transformed by the far ear transfer function A and sound from the left speaker propagates to the right ear and is also transformed by the far ear transfer function A.

Figure 3A:
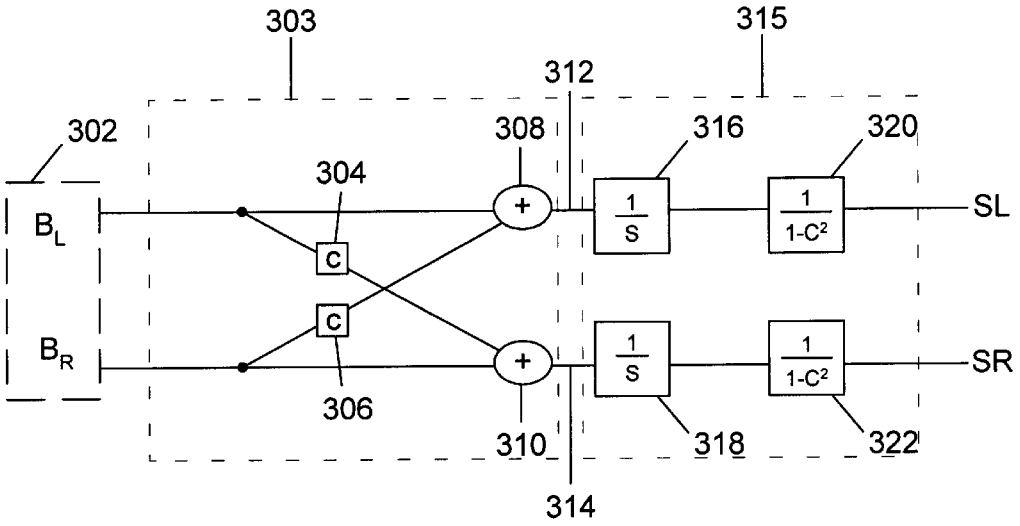
FIGURE 3A PRIOR ART
FIG. 3A is a block diagram of a system for canceling crosstalk.

FIG. 3A is a block diagram of a system for canceling crosstalk. A binaural signal 302 is input into the system consisting of a left channel BL and a right channel BR. Crosstalk removal circuit 303 includes filter 304 and filter 306, as well as summing circuit 308 and summing circuit 310. Filter 304 and filter 306 implement the transfer function C which is equal to −A/S. Summing circuit 308 adds the left channel signal BL to the right channel signal which has passed through and been transformed by filter 304. Summing circuit 310 adds the right channel signal BR to the left channel signal which has passed through and been transformed by filter 306. Equalization circuit 315 includes Naturalizing filter 316 and naturalizing filter 318 in addition to echo canceling filter 320 and echo canceling filter 322. The naturalizing filters remove the effect of the near ear transfer function S. The operation of the echo canceling filters will be described below.

Figure 3B:
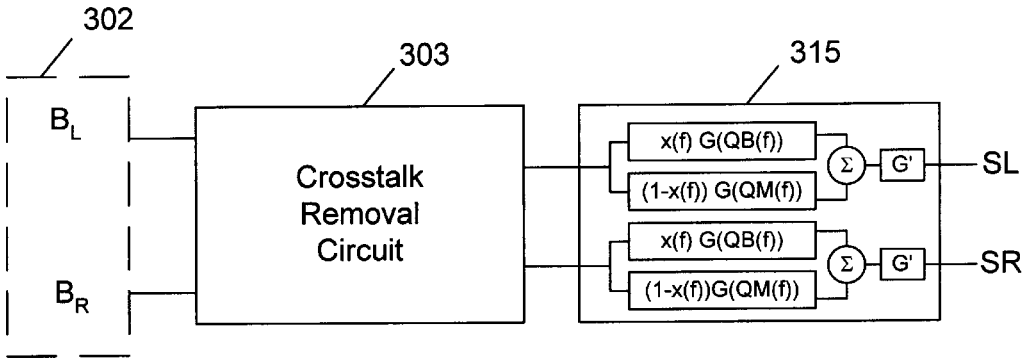
FIG. 3B is a block diagram of a system for canceling crosstalk.

FIG. 3B is a simplified block diagram of a system for canceling crosstalk. Again, binaural signal 302 is input into the system consisting of a left channel BL and a right channel BR. Crosstalk removal circuit 303 removes the crosstalk caused by signals from each speaker propagating to both ears. Crosstalk equalization circuit 315 equalizes the output signals from crosstalk removal circuit 303. Left and right speaker signals SL and SR are output from equalization circuit 315.

For each input, equalization circuit 315 implements a function that is a frequency crossfade of a monaurally transparent transfer function OM(f) and a binaurally transfer function OBE(f). The two transfer functions are multiplied by the crossfade terms X(f) and (1−X(f) and the results are added together at a summing junction. In addition, in the embodiment shown, a function G operates on the two transfer functions and G' operates on the output of the summing junction.

It should be noted that equalization circuit 315 is shown in FIG. 3 operating on the output of crosstalk removal circuit 303; but that the equalization circuit 315 could equivalently operate directly on BL and BR, with the output of equalization circuit 315 directed to crosstalk removal circuit 303. Crosstalk canceling circuit 303 is one example of a crosstalk canceling circuit known as a "butterfly canceler." Other crosstalk canceling circuits which are well known in the art may also be used. These include the lattice canceler and the shuffler canceler which are described in the patents issued to Cooper et. al. described above. In certain of these other canceler architectures such as the lattice canceler and the shuffler canceler, the equalization and crosstalk removal processes are not separately implemented as they are in the butterfly canceler architecture of FIG. 3.

Figure 4:
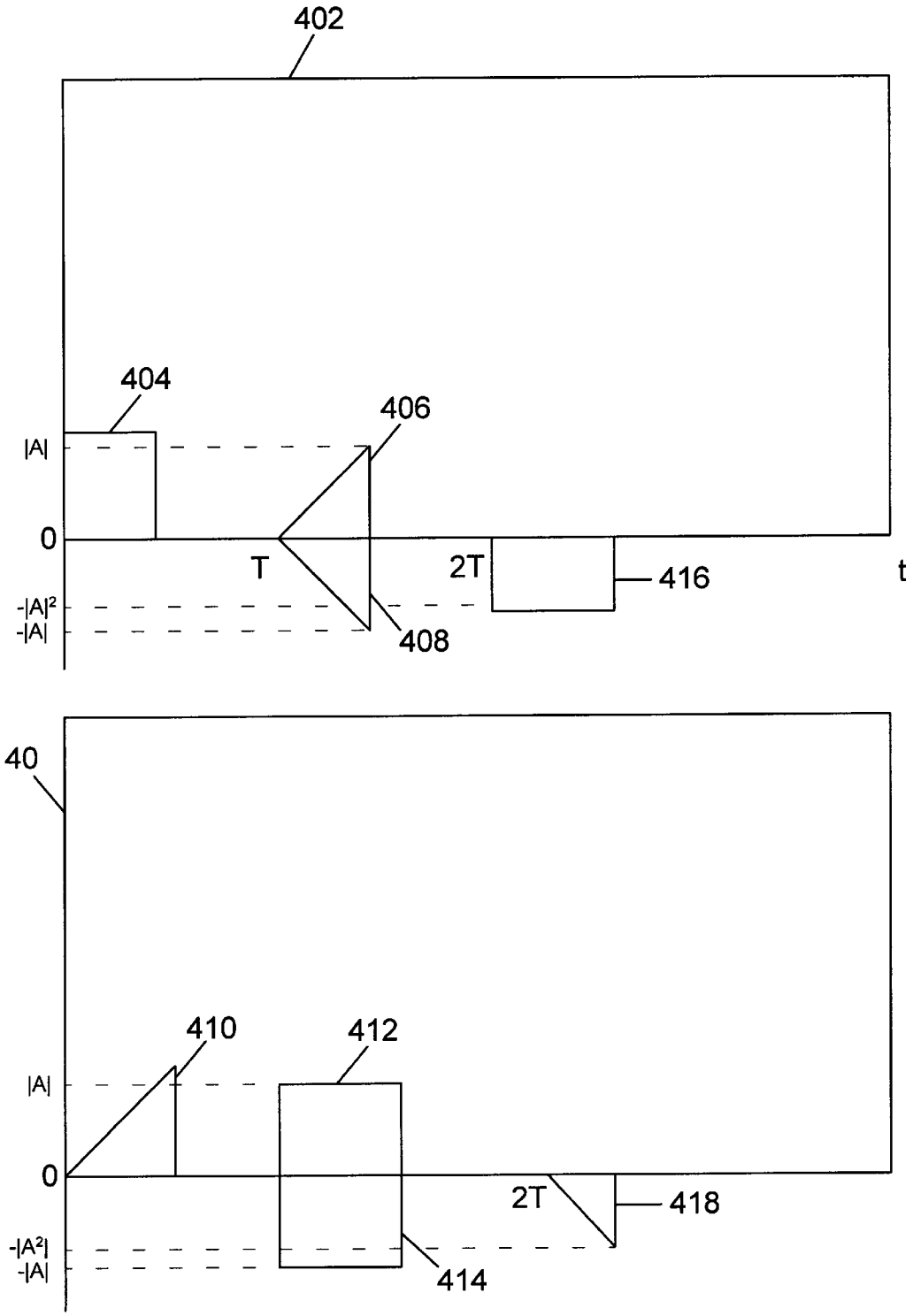
FIG. 4 illustrates an example of a sound signal which would be received by a left ear and a sound signal which would be received by a right ear plotted in the time domain.

FIG. 4 illustrates an example of a sound signal which would be received by a left ear and a sound signal which would be received by a right ear plotted in the time domain if the outputs of crosstalk removal circuit 303 at point 312 and point 314 are output to left and right speakers, respectively. For simplicity in this illustration, the near ear transfer function S is set equal to one, that is, signals are assumed to propagate from each speaker to its respective near ear unchanged. In addition, the far ear transfer function is assumed to be a positive constant independent of frequency, |A|, and a pure time delay ,T. Due to head shadowing and other propagation effects, speaker signals arrive at the far ear with less amplitude and later than they arrive at the near ear. As a result, the far ear transfer function A has a magnitude |A| which is less than one and a positive time delay of T.

Graph 402 depicts the sound signal received by the listener's left ear. The left channel portion of the binaural signal BL is represented by a square pulse of unit amplitude. BL is fed through summing circuit 308 to a left speaker and arrives unchanged at the left ear at time zero as pulse 404, since S=1 in this example. The right channel portion of the binaural signal, BR, is represented by a unit amplitude ramp function. The right channel signal, BR, is sent through summing circuit 310 to a right speaker. As the right channel signal propagates through space to the left ear, it is operated on by the far ear transfer function A, so that it arrives at the left ear as pulse 406 after a time delay of T and attenuated by a factor of |A|. Pulse 406 is a crosstalk signal from the right speaker which propagates to the listener's left ear. Binaural signal BR is also passed through filter 306 and summing circuit 308 to be output through the left speaker. Filter 306 implements the transfer function −A/S which in this example is equivalent to −A. This results in pulse 408, which has amplitude −|A|, arriving at the listener's left ear at time T and exactly canceling pulse 406.

Graph 404 depicts the sound signal received by the listener's right ear. BR is fed through summing circuit 310 to a right speaker and arrives at the right ear as pulse 410 at time zero unchanged, since S=1. Likewise, the left channel signal BL is sent through summing circuit 308 to the left speaker. As the left channel signal propagates through space to the right ear, it is operated on by the far ear transfer function A and so it arrives at the right ear as pulse 412 after a time delay of T and attenuated by a factor of |A|. Pulse 412 is a crosstalk signal from the left speaker which propagates to the listener's right ear. Binaural signal BL is also passed through filter 304 and summing circuit 310 and output through the right speaker. Filter 304 implements the transfer function −A/S which in this example is equivalent to −A. This results in pulse 414, which has amplitude −|A|, arriving at the listener's right ear at time T and exactly canceling pulse 412.

So far, this example shows that crosstalk is canceled by crosstalk remover 303. However, in removing the left channel binaural signal from the right ear and in removing the right channel binaural signal from the left ear, negative going echoes of the left and right channel binaural signals are created. At the left ear, the signal which passed through filter 304 and summing circuit 310 in order to cancel pulse 412 arrives at time 2T after being operated on by transfer function A. This signal is shown as pulse 416, with amplitude $-|A|^2$. Similarly, at the right ear, the signal which passed through filter 306 and summing circuit 308 in order to cancel pulse 406 arrives at time 2T after being operated on by transfer function A. This signal is shown as pulse 416, with amplitude $-|A|^2$.

The purpose of echo canceling filter 320 and echo canceling filter 322 is to cancel echo 416 and echo 418. Echo canceling filter 320 and echo canceling filter 322 are shown implementing the transfer function $1/(1-C^2)$. Combined with naturalizing filter 316 and naturalizing filter 318, the overall equalization transfer function implemented by equalization circuit 315, QB $=1/(S\ (1-C^2))$, is referred to as a binaurally transparent equalization transfer function because it will cause the binaural signal to appear at the ears of the listener unchanged. The term "transparent" indicates that the signal is applied to the ears of the listener as if the intervening physical and electrical system were not there, i. c. the physical and electrical systems are "transparent" to the listener. Put differently, using a binaurally transparent equalization, the signal arrives at the listener's ears as if applied via headphones.

Figure 5A:
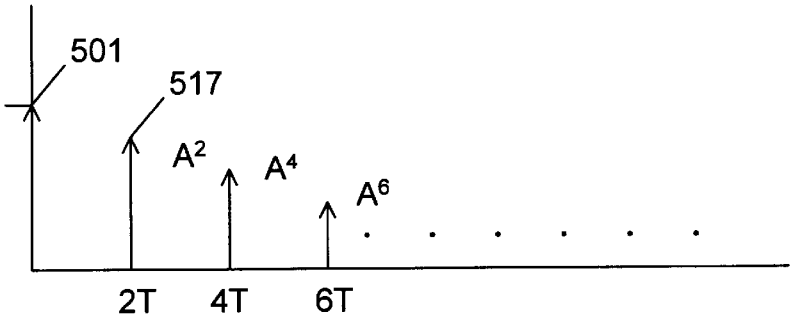
FIG. 5A shows the impulse response of a filter which implements the binaurally transparent equalization transfer function.
Figure 5B:
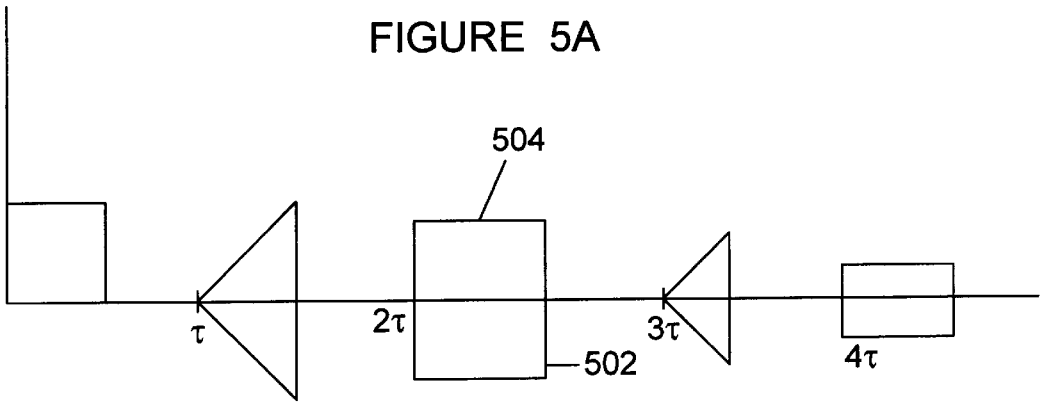
FIG. 5B shows a signal propagated to the left ear.
Figure 5C:
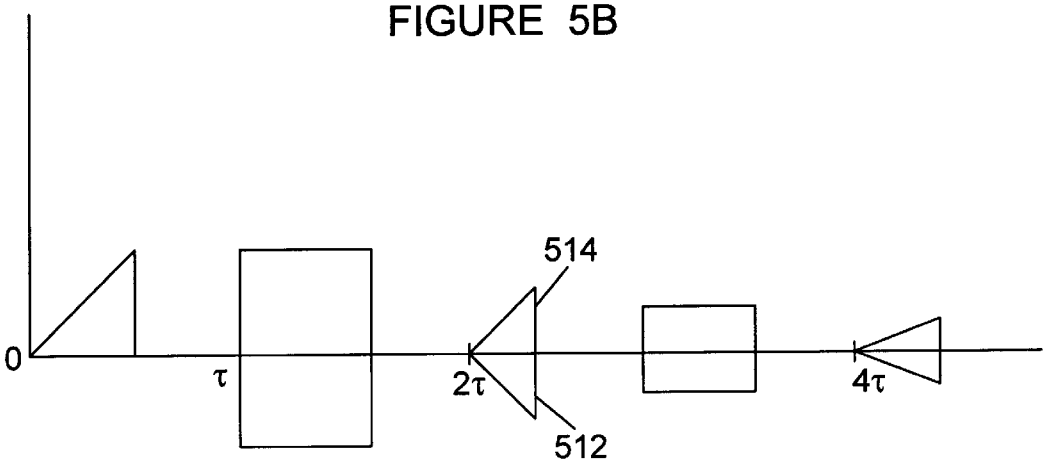
FIG. 5C shows a signal propagated to the right ear.

FIG. 5A shows the impulse response of a filter which implements the binaurally transparent equalization transfer function. The filter produces a delta function of unit amplitude at time 0 followed by a series of delta functions separated in time by 2T, where T is the time delay associated with the transfer function A, each having an amplitude equal to $|A|^2$ times the amplitude of its predecessor. The resulting output of the system is SL, a left speaker signal, and SR, a right speaker signal. FIG. 5B shows the resulting signal at the left ear and FIG. 5C shows the resulting signal at the right ear when the signals BL and BR from FIG. 4 are input into the system.

Referring to FIG. 5B, the first delta function of unit amplitude in FIGURE SA produces the same output as is shown in FIG. 4. Negative echo 502 is canceled by pulse 504 which results from the first delayed and attenuated impulse 517 of the equalization filter. Each successively smaller pulse is also canceled so that the signal BL is transparently reproduced at the left ear. Similarly, FIG. 5C shows the resulting signal at the listener's right ear. Negative echo 512 is canceled by pulse 514 which results from the first delayed and attenuated impulse 517 of the equalization filter. Each successively smaller pulse is also canceled so that the signal BR is transparently reproduced at the right ear.

As described above, the binaurally transparent equalization filter works ideally so long as the listener's head remains positioned and oriented correctly in the sweet spot and the listener's HRTF is implemented correctly by the system. However, performance is degraded if the listener is not properly positioned or has an HRTF which differs significantly from the HRTF used in the crosstalk canceler. From the examples shown in FIG. 5B and FIG. 5C, it can be seen that binaurally transparent equalization can create phantom echoes. For example, when the listener moves away from the sweet spot, the time delay T associated with the transfer function C implemented by the various filters no longer corresponds to the physical time delay experienced by the listener between signals propagated to the near ear and the far ear. Therefore the long positive going and negative going trains of decaying pulses generated by the equalization filters do not cancel, and the listener perceives a timbre change in the binaural signal.

Another commonly used equalization is monophonic compatible equalization. The transfer function of the monophonic compatible equalizer is QM=1/(1−C). When monophonic compatible equalization is used, the system is transparent to monophonic signals, that is monophonic signals pass through the system unchanged (except perhaps for a delay.) Many sound recordings have a high monophonic content, especially for sources such as dialog or other voice content or featured instruments which are often centered in the stereo image. Monophonic compatibility is useful in such systems because sounds from monophonic sources do not have their timbre altered or become colored. The disadvantage of such systems, however, is that non-monophonic signal content is colored even when the listener's head is positioned and oriented correctly in the sweet spot of the system.

In one embodiment, the present invention implements an equalization filter which has a transfer function that has a magnitude similar to a monophonic compatible equalization transfer function at certain frequencies and a magnitude similar to a binaurally transparent equalization transfer function at other frequencies. The magnitude of the monophonic compatible equalization transfer function is followed at frequencies for which there is expected to be a high monophonic signal content, such as frequencies which include dialog. In one embodiment, the monophonic compatible portion of the equalization extends over the frequency range between DC and about 1.5. kHz. The magnitude of the binaurally transparent equalization transfer function is followed at other frequencies, particularly at high frequencies greater than 5 kHz where important spatial hearing cues are present. The two different equalization magnitudes are blended so that the hybrid transfer function magnitude at any given frequency is a combination of the binaurally transparent and the monophonic compatible transfer function magnitudes weighted in such a way as to reflect the relative importance of the monophonic compatible and binaurally transparent equalizations. Once the magnitude of the desired equalization transfer function is determined as a function of frequency, then the phase of the equalization transfer function is free to be chosen. In one embodiment, a minimum phase equalization transfer function is implemented.

In one embodiment, an equalization filter is implemented which has a transfer function that has a magnitude corresponding to a monophonic compatible filter transfer function at low frequencies and a magnitude corresponding to a binaurally transparent filter transfer function at high frequencies. A cross fade function which varies with frequency, X(f), is used to combine the two equalization transfer functions. The cross fade function X(f) is a symmetric function of frequency which is greater than or equal to zero and is less than or equal to one. The crossfade function X(f) is multiplied by one of the filter magnitude functions which is to be combined and the complement of X(f), 1−X(f), is multiplied by the other filter magnitude function which is to be combined, thus producing a weighted average of the two filter function magnitudes. In one embodiment, a linear cross fade is used: X(f)=f/20 kHz where frequency is measured in kHz. The binaurally transparent filter function magnitude , |B(f)| is multiplied by X(f) and the monophonic compatible filter function magnitude, |M(f)| is multiplied by (1−X(f)) so that the characteristics of the binaurally transparent filter function magnitude dominates the equalization transfer function magnitude at high frequencies and the monophonic compatible filter function magnitude dominates at lower frequencies.

Figure 6A:
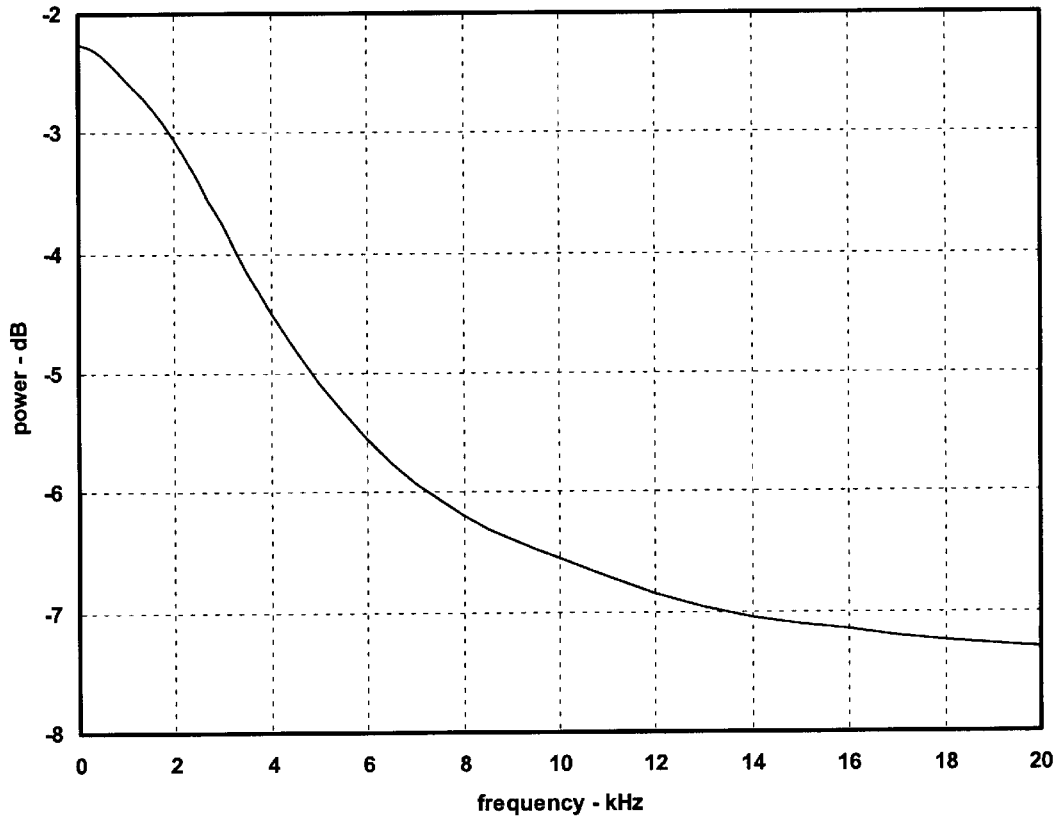
FIG. 6A shows a plot of the magnitude of C, the ratio of the far ear transfer function to the near ear transfer function, for an example listener and speaker geometry.
Figure 6B:
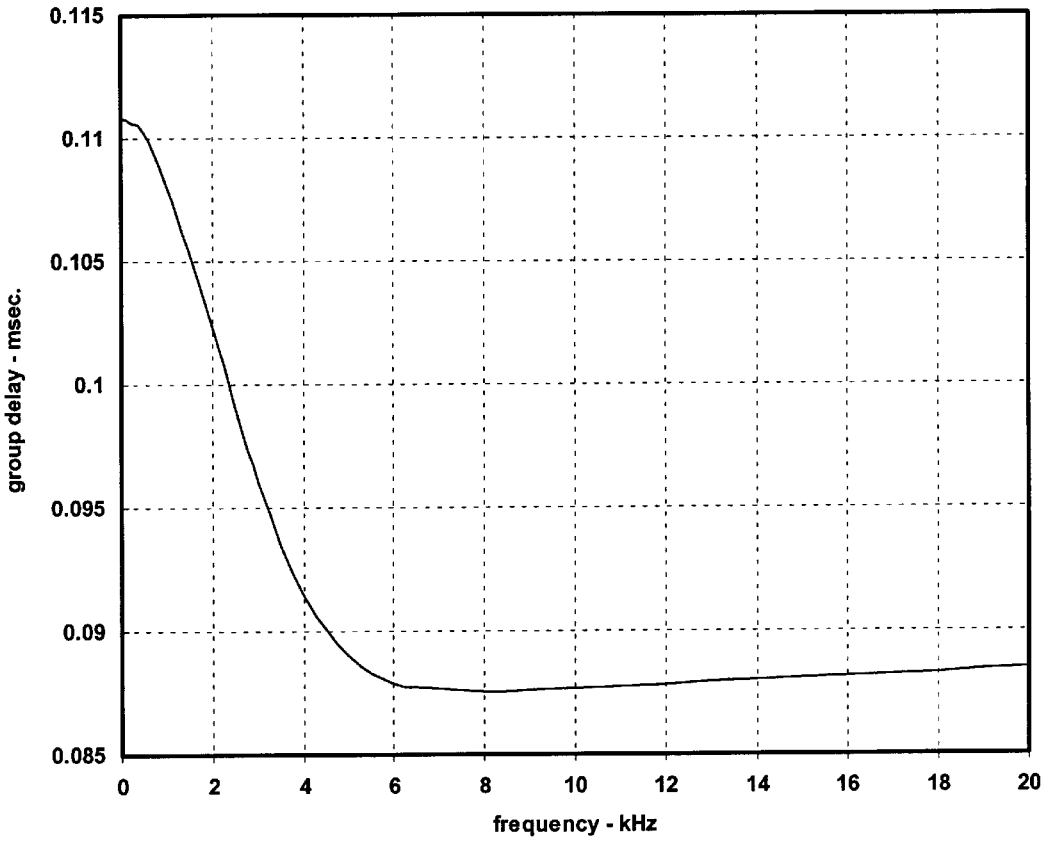
FIG. 6B shows a plot of the group delay (time delay as a function of frequency) associated with the example ratio C shown in FIG. 6A.
Figure 6C:
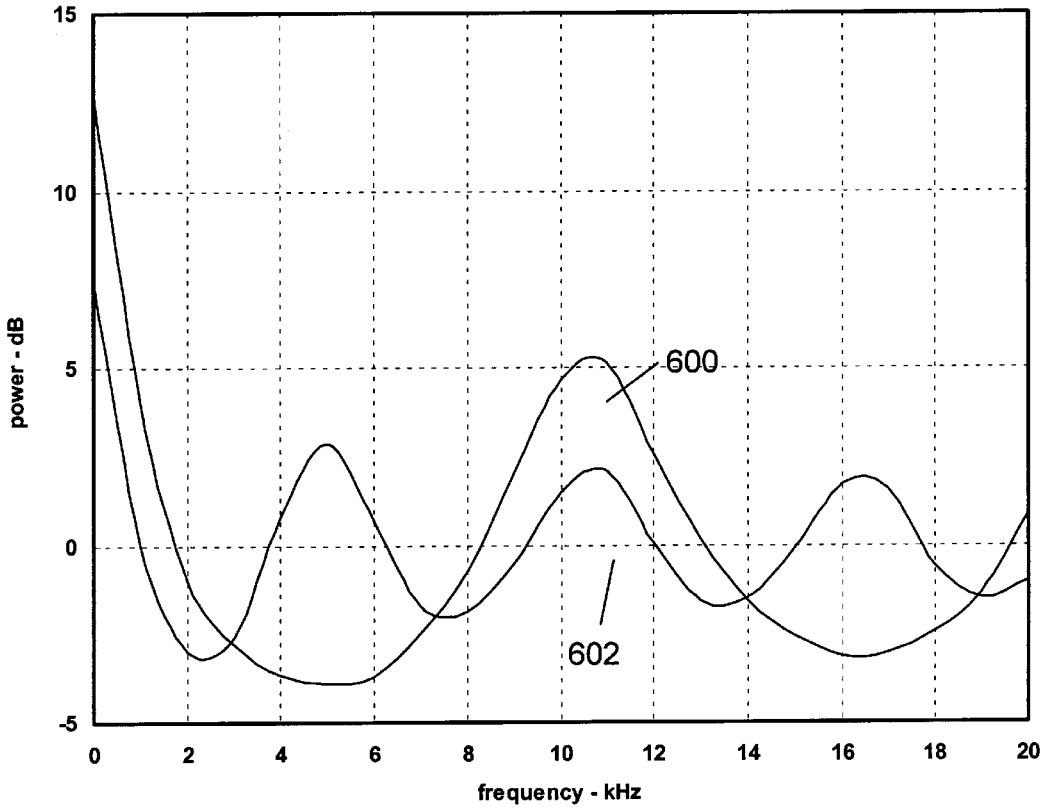
FIG. 6C shows a plot of the magnitude of the monophonic compatible equalization function as a function of frequency and a plot of the magnitude of the binaurally transparent equalization function as a function of frequency for the ratio C shown in FIG. 6A and FIG. 6B.
Figure 6D:
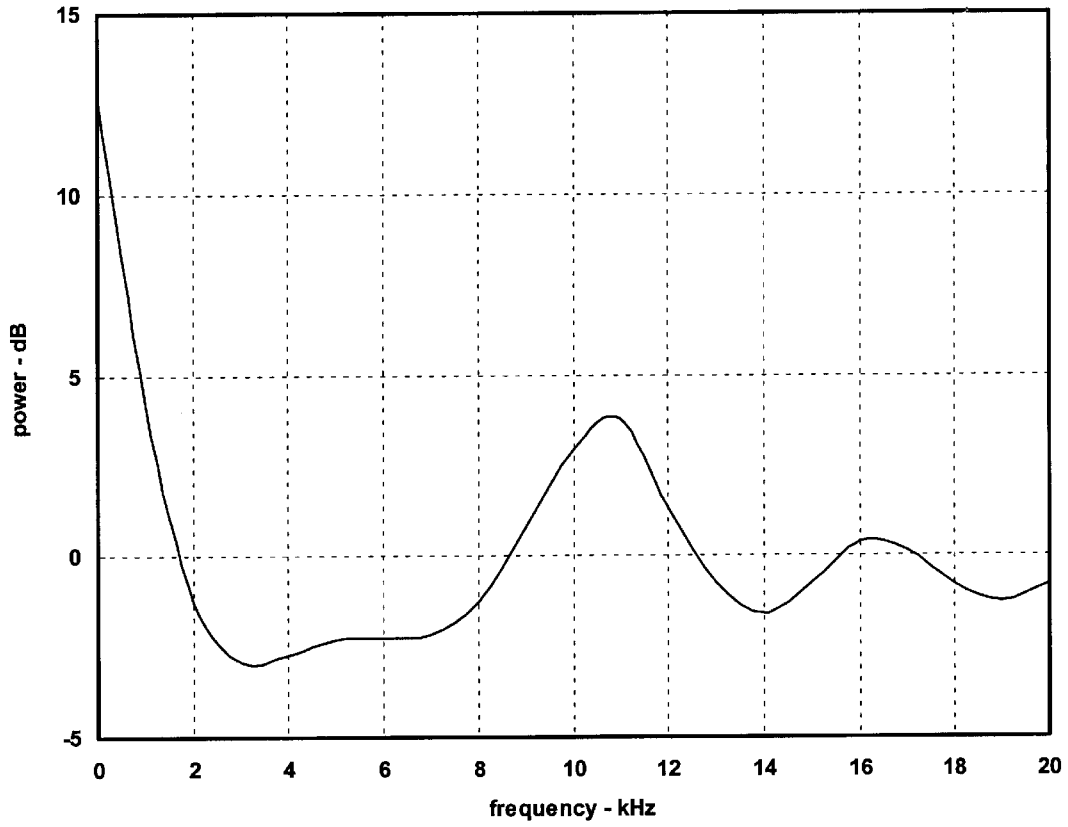
FIG. 6D illustrates the magnitude of the transfer function described above.

In one embodiment, the equalization transfer function, Q(f), is implemented with a filter whose log magnitude approximates the frequency crossfade between the log magnitude of the monophonic compatible equalization transfer function, QM(f), and the log magnitude of the binaurally transparent equalization transfer function, QB(f):

$$\log |Q(f)| = X(f) \log (|QM(f)|) + (1 - X(f)) \log (|QB(f)|)$$

where X(f) is a crossfade function having the properties described above . In one embodiment, X(f) is monotonic in absolute frequency |f|, favoring the monophonic compatible equalization at one end of the spectrum and the binaurally transparent equalization at the other end. By ramping the crossfade function X(f) from one near DC to zero near the band edge, the equalization magnitude will be substantially monophonic compatible at low frequencies, and substantially binaurally transparent at high frequencies, as illustrated in the example of FIGS. 6A–6D. In this example, the crossfade function X(f) is a linear ramp from one at DC to zero at about 20 kHz. FIG. 6A shows a plot of the magnitude of C, the ratio of the far ear transfer function to the near ear transfer function, for an example listener and speaker geometry. FIG. 6B shows a plot of the group delay (time delay as a function of frequency) associated with the example ratio C shown in FIG. 6A. FIG. 6C shows at curve 600 a plot of the magnitude of the monophonic compatible equalization function as a function of frequency and at curve 602 a plot of the magnitude of the binaurally transparent equalization function as a function of frequency for the ratio C shown in FIG. 6A and FIG. 6B. FIG. 6D illustrates the magnitude of the transfer function described above which is a combination of the monophonic compatible equalization transfer function and the binaurally transparent equalization transfer function.

In some embodiments, a first function is applied to the binaurally transparent transfer function and to the monophonic compatible transfer function before the cross fade is applied. After the frequency cross fade is applied, then a second function is applied to the frequency cross fade and the output of the second function is the magnitude of the hybrid filter. In the embodiment illustrated above in FIG. 6A–6D, the first function is the log magnitude function and the second function is the exponential. In another embodiment, the first function is the square magnitude and the second function is the square root.

The linear cross fade function is just one example of a cross fade function which is used in some embodiments. Any cross fade can be used to combine the binaurally transparent filter function magnitude and the monophonic compatible filter function magnitude in accordance with the present invention. Additionally, any pair of functions may be applied to the binaurally transparent filter function magnitude and to the monophonic compatible filter function magnitude before and after the cross fade is applied in accordance with the present invention.

Although the foregoing invention has been described in some detail for purposes of clarity of understanding, it will be apparent that certain changes and modifications may be practiced within the scope of the appended claims. It should be noted that there are may alternative ways of implementing both the process and apparatus of the present invention. It is therefore intended that the following appended claims be interpreted as including all such alterations, permutations, and equivalents as fall within the spirit and scope of the present invention.

What is claimed is:

1. A method for providing a two channel signal to the ears of a listener through an audio system including a plurality of audio signals which are played through a plurality of loudspeakers, and a plurality of propagation paths from said loudspeakers to the ears of said listener comprising:

canceling the crosstalk in said audio system by providing said two channel signal which is to be received at the ears of said listener as an input to a crosstalk compensating network, said crosstalk compensating network being operative to provide an inverse crosstalk signal which cancels the crosstalk caused by the propagation of said audio signals from said plurality of loudspeakers along said plurality of propagation paths to the ears of said listener;

equalizing said two channel signal via an equalization transfer function whose magnitude is substantially proportional to a first function applied to the frequency crossfade between a second function of a monophonic compatible equalization transfer function and said second function of a binaurally transparent equalization function; and generating said plurality of audio signals which are suitable for playback through said plurality of audio speakers and propagation to the ears of said listener.

2. The method of claim 1 wherein equalizing said two channel signal via an equalization transfer function occurs before canceling the crosstalk in said audio system.

3. The method of claim 1 wherein equalizing said two channel signal via an equalization transfer function occurs after canceling the crosstalk in said audio system.

4. The method of claim 1 wherein equalizing said two channel signal via an equalization transfer function occurs simultaneously with canceling the crosstalk in said audio system.

5. The method of claim 1 wherein said first function is an exponential function and said second function is the log magnitude function.

6. The method of claim 1 wherein said first function is a square root function and said second function is a square magnitude function.

7. The method of claim 1 wherein said first function is the identity and said second function is a magnitude function.

8. The method of claim 1 wherein said first function is the inverse of the second function.

9. The method of claim 1 wherein the crossfade function associated with the frequency crossfade is a linear crossfade function.

10. The method of claim 1 wherein the crossfade function is chosen such that the characteristics of the binaurally transparent equalization function magnitude dominate at high frequencies and characteristics of the monophonic compatible equalization transfer function dominate at low frequencies.

11. The method of claim 1 wherein the crossfade function is chosen such that the characteristics of the binaurally transparent equalization function magnitude dominate at frequencies above about 1.5 KHz and characteristics of the monophonic compatible equalization transfer function dominate at frequencies below about 1.5 KHz.

12. The method of claim 1 wherein the equalization transfer function is a minimum phase transfer function.

13. The method of claim 1 wherein the two channel signal includes the left and right channel signals associated with a virtual sound source.

14. The method of claim 1 wherein the two channel signal includes the left and right channel signals associated with a plurality of virtual speakers.

15. The method of claim 1 wherein the two channel signal includes the left and right channel signals associated with a plurality of virtual speakers arranged in a home theater surround sound system configuration.

16. A crosstalk cancellation system for providing a two channel signal to the ears of a listener through an audio system including a plurality of audio signals which are played through a plurality of loudspeakers, and a plurality of propagation paths from said loudspeakers to the ears of said listener comprising:

a crosstalk canceler including a crosstalk compensating network, said crosstalk compensating network being operative to provide an inverse crosstalk signal which cancels the crosstalk caused by the propagation of said audio signals from said plurality of loudspeakers along said plurality of propagation paths to the ears of said listener; and an equalizer configured to equalize said two channel signal via an equalization transfer function whose magnitude is substantially proportional to a first function applied to the frequency crossfade between a second function of a monophonic compatible equalization transfer function and said second function of a binaurally transparent equalization function; and whereby said plurality of audio signals which are suitable for playback through said plurality of audio speakers and propagation to the ears of said listener are generated.

17. The crosstalk cancellation system of claim 16 wherein said crosstalk canceler is configured to receive said two channel signal which is to be received at the ears of said listener as an input, and the output of said crosstalk canceler is configured to be received as the input of said equalizer.

18. The crosstalk cancellation system of claim 16 wherein said equalizer is configured to receive said two channel signal which is to be received at the ears of said listener as an input, and the output of said equalizer is configured to be received as the input of said crosstalk canceler.

19. The crosstalk cancellation system of claim 16 wherein said crosstalk canceler and said equalizer are integral with each other.

20. The crosstalk cancellation system of claim 16 wherein said first function is an exponential function and said second function is the log magnitude function.

21. The crosstalk cancellation system of claim 16 wherein said first function is a square root function and said second function is a square magnitude function.

22. The crosstalk cancellation system of claim 16 wherein said first function is the identity and said second function is a magnitude function.

23. The crosstalk cancellation system of claim 16 wherein said first function is the inverse of the second function.

24. The crosstalk cancellation system of claim 16 wherein the crossfade function associated with the frequency crossfade is a linear crossfade function.

25. The crosstalk cancellation system of claim 16 wherein the crossfade function is chosen such that the characteristics of the binaurally transparent equalization function magnitude dominate at high frequencies and characteristics of the monophonic compatible equalization transfer function dominate at low frequencies.

26. The crosstalk cancellation system of claim 16 wherein the crossfade function is chosen such that the characteristics of the binaurally transparent equalization function magnitude dominate at frequencies above about 1.5 KHz and characteristics of the monophonic compatible equalization transfer function dominate at frequencies below about 1.5 KHz.

27. The crosstalk cancellation system of claim 16 wherein the equalization transfer function is a minimum phase transfer function.

28. The crosstalk cancellation system of claim 16 wherein the two channel signal includes the left and right channel signals associated with a virtual sound source.

29. The crosstalk cancellation system of claim 16 wherein the two channel signal includes the left and right channel signals associated with a plurality of virtual speakers.

30. The crosstalk cancellation system of claim 16 wherein the two channel signal includes the left and right channel signals associated with a plurality of virtual speakers arranged in a home theater surround sound system configuration.

* * * * *

UNITED STATES PATENT AND TRADEMARK OFFICE

CERTIFICATE OF CORRECTION

PATENT NO. : 6,009,178
DATED : December 28, 1999
INVENTOR(S) : Abel et al.

It is certified that error appears in the above-identified patent and that said Letters Patent is hereby corrected as shown below:

Column 5,
Line 3, change "OM(f)" to -- QM(f) --.
Line 4, change "OBE(f)" to -- QB(f) --.
Line 20, change "et. al." to -- et al. --.

Column 6,
Line 35, change "i.c." to -- i.e. --.
Line 53, change "FIGURE SA" to -- FIGURE5A --.

Signed and Sealed this

Ninth Day of October, 2001

*Attest:*

Nicholas P. Godici

NICHOLAS P. GODICI
*Acting Director of the United States Patent and Trademark Office*

*Attesting Officer*